US007318774B2

(12) United States Patent
Bryant et al.

(10) Patent No.: US 7,318,774 B2
(45) Date of Patent: Jan. 15, 2008

(54) GAMING MACHINE-MEMBERSHIP REWARD SYSTEM

(75) Inventors: Natalie Bryant, Rosebery (AU); Scott Olive, Rosebery (AU)

(73) Assignee: Aristocrat Technologies Austalia Pty. Ltd., Lane Cove, New South Wales (AU)

( * ) Notice: Subject to any disclaimer, the term of this patent is extended or adjusted under 35 U.S.C. 154(b) by 747 days.

(21) Appl. No.: 10/275,364

(22) PCT Filed: May 2, 2001

(86) PCT No.: PCT/AU01/00497

§ 371 (c)(1),
(2), (4) Date: Jul. 25, 2003

(87) PCT Pub. No.: WO01/83063

PCT Pub. Date: Nov. 8, 2001

(65) Prior Publication Data

US 2004/0038736 A1 Feb. 26, 2004

(30) Foreign Application Priority Data

May 3, 2000 (AU) ..... PQ7264

(51) Int. Cl.
*A63F 9/24* (2006.01)

(52) U.S. Cl. ..... 463/25; 463/20

(58) Field of Classification Search ..... 463/25, 463/20, 29, 23

See application file for complete search history.

(56) References Cited

U.S. PATENT DOCUMENTS

| | | | | |
|---|---|---|---|---|
| 5,655,961 | A * | 8/1997 | Acres et al. | 463/27 |
| 5,766,076 | A * | 6/1998 | Pease et al. | 463/27 |
| 5,833,540 | A | 11/1998 | Miodunski et al. | |
| 6,039,648 | A * | 3/2000 | Guinn et al. | 463/16 |
| 6,135,884 | A * | 10/2000 | Hedrick et al. | 463/20 |
| 6,319,125 | B1 * | 11/2001 | Acres | 463/25 |
| 6,364,768 | B1 * | 4/2002 | Acres et al. | 463/25 |

FOREIGN PATENT DOCUMENTS

| | | |
|---|---|---|
| DE | 4200254 | 8/1993 |
| DE | 19701214 | 7/1998 |
| JP | 8-187352 | 7/1996 |
| WO | WO 98/47115 | 10/1998 |
| WO | WO 00/03775 | 1/2000 |

* cited by examiner

*Primary Examiner*—Robert E Pezzuto
(74) *Attorney, Agent, or Firm*—McAndrews, Held & Malloy, Ltd.

(57) ABSTRACT

A gaming machine is provided, which is arranged to play a game having 2 modes wherein the base game, when in the first mode, has a standard set of features and when in the second mode has an enhanced set of features which improve its attractiveness to players. The first game mode is available to all players and the second enhanced game mode is made available to players who have established membership in a group by inserting a members card.

95 Claims, 7 Drawing Sheets

BONUS MODE IS OFF

CREDIT 100 BET 20 WIN 40

| | | | | |
|---|---|---|---|---|
| C | J | S | 10 | J |
| S | 9 | 9 | J | A |
| A | Q | 10 | S | 10 |

FIG. 5

BONUS MODE IS ON

CREDIT 120 BET 20 WIN 40

| | | | | |
|---|---|---|---|---|
| C | J | S | 10 | A |
| S | 9 | Q | J | J |
| 10 | 9 | A | S | 10 |

FIG. 6

GAMING MACHINE-MEMBERSHIP REWARD SYSTEM

INTRODUCTION

The present invention relates to gaming machines of the type generally known as slot machines, fruit machines, card machines or poker machines and in particular, the invention provides an improvement whereby players are rewarded for frequenting a particular establishment.

BACKGROUND OF THE INVENTION

Gaming machines are typically installed in large numbers at casinos and clubs which compete against one another for the custom of patrons wishing to play their games. Typically, this competition involves providing attractions such as the latest games, promotions associated, with or additional to the games played on their gaming machines and large incrementing bonus jackpots.

These attractions work to some extent, but the smart gamblers choose to play at establishments based on the current promotions that are being run, or the current size of the incrementing jackpots, and so there is a certain fluctuation in patronage due to the fickle nature of the patrons and the changing attractions of the promotions being run.

Some establishments have addressed this problem over the years by providing loyalty schemes. There exist many different systems used by clubs and casinos where regular players are rewarded. Some are manual where players that are recognised as spending a lot of time playing the machines are given free meals or discounts. More sophisticated systems involve players being sold or given a plastic card (eg. magnetic stripe or smartcard) that they can insert into a special reader on the gaming machines at the applicable club/casino. Points are accumulated at a fixed rate and stored on the card or in a central account. When the player accumulates a fixed number of points they become eligible to redeem them in exchange for goods. Players are usually given a range of goods to choose from where the number of points that need to be redeemed for each item varies depending upon the value of the item.

SUMMARY OF THE INVENTION

The present invention provides a gaming console having a display means, player input means, and control means arranged to control images displayed on the display means in response to player inputs and game outcomes of games run on the console by the player, the console being characterised in that it is arranged to operate in at least two modes, including a first normal mode and a second loyalty enhanced mode, wherein the first mode is available to all players and the second mode is made available only to players who have established themselves as eligible members of a club or other special group.

In various embodiments of the invention, the second mode may be distinguished from the first mode by providing higher prizes or additional prizes, allowing additional game features either as standard features, or as purchasable features within a standard game, or by providing eligibility to additional feature games, and bonus or jackpot prizes.

In the preferred embodiment, the main, or base game will be a card game or spinning reel game with or without additional feature games, but may also be a keno or bingo game, or any other game which can be provided on a gaming console of this type.

Membership of the eligible group may be signified by use of special keys, passwords or other identification means, but preferably by way of an identification card. The loyalty system may be implemented on "stand alone" consoles and on networked consoles. In the case of networked systems, player details can be maintained on a network server, or a dedicated loyalty system server for example, and the player identification card or other identification means can be used only to identify the player to the system. In the case of stand alone gaming consoles, the console will be provided with a card reader that reads a special membership card. When the card is inserted into the card reader the console will recognise the player as a member and the player will become eligible for the features of the loyalty enhanced mode. It is not essential, although it is preferable, that the console recognises the player's identity for the enhanced mode to operate, only that the player be recognised as a member of the class eligible for the enhanced mode.

In the case where the second mode provides a feature game, the feature game may be an independent second screen game. Alternatively, a bonus feature may be related to particular outcomes on the main game, such as providing prizes for outcomes over a certain level or containing certain indicia. The loyalty feature may also be related to a system event in a linked system and may for example, involve providing eligibility to a progressive jackpot.

Some specific examples of bonus rewards that can be provided to a player when their membership loyalty card is inserted may include:

a) In the event that 3 scatter symbols are spun up in a bought game, 10 free games are awarded.

b) In the event that an EYE symbol appears at the same time on reels 2 & 4, pay a bonus of 5 credits for every KING that appears in the next 20 games.

c) Every time a substitute symbol substitutes for another symbol in a win, a second screen feature is awarded, which pays a bonus prize.

Where features already exist as part of a standard game, and are available independently of a loyalty card being inserted, some or all of those features may be extended when a player's loyalty card has been inserted:

a) When a trigger comprising 3 or more scatter symbols occurs without the card inserted, 10 free games are awarded, but when the game trigger occurs with the loyalty card inserted into the machine's card reader, 20 free games are awarded.

b) When a loyalty card is not inserted, 2 or more substitute symbols appearing in a win, triggers a second screen feature, whereas, while the loyalty card is inserted only 1 or more substitute symbols are required to trigger the same feature.

BRIEF DESCRIPTION OF THE DRAWINGS

Embodiments of the invention will now be described by way of example with reference to the accompanying drawing in which:

FIGS. 5, 6, & 7, are game screens illustrating a game sequence which demonstrates the invention.

DETAILED DESCRIPTION OF THE PREFERRED EMBODIMENT

In the following detailed description the methodology of the embodiments will be described, and it is to be understood that it is within the capabilities of the non-inventive worker in the art to introduce the methodology on any standard processor-based gaming console by means of appropriate programming.

Figure 1:
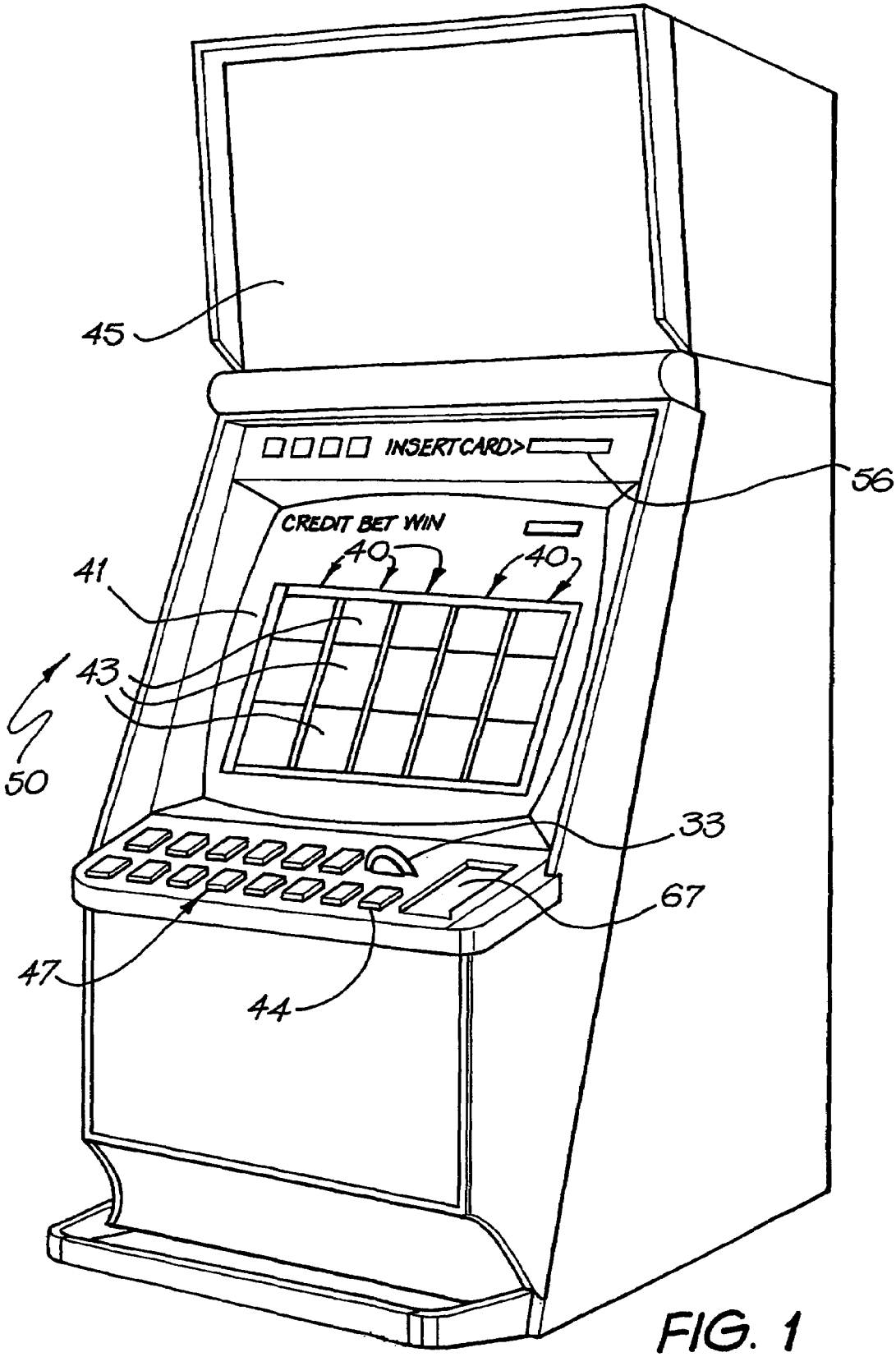
FIG. 1 illustrates a conventional video slot machine on which the embodiment of the present invention is provided.

Referring to FIG. 1 of the drawings, a first embodiment of the invention is implemented in relation to a slot machine 50 of the type having a video display illustrating a plurality of rotatable simulated reels 40 carrying symbols 43. During a game, the plurality of simulated reels are spun and when the reels stop spinning, a part of each reel is visible displaying a subset of the symbols on the respective reel. The console is arranged to pay a prize on the occurrence of a predetermined symbol or combination of symbols appearing together on the visible parts of the reels.

The prize paying combinations can be any of the combinations found on known spinning reel style slot machines, or may be a new set of combinations derived specifically for machines according to the invention.

In the slot machine 50 illustrated in FIG. 1, the game is initiated by pressing a button 44, however, it will be recognised by persons skilled in the art that this operating mechanism might be replaced by a pull handle actuator, or a touch screen sensor, in other embodiments of the invention. Credit is established on the slot machine by inserting coins into the coin slot 33, inserting a banknote or ticket into the bill acceptor 67 or possibly by inserting a card into the card reader and transferring credit either from an account held at the casino or at a financial institution or by transferring a credit from a stored value on the card itself.

The top box 45 on top of the slot machine 50 displays the various winning combinations for which a prize is paid on this machine.

In the embodiment of FIG. 1 a series of function switches 47 are also provided for selection of the bets and lines to be included in the game.

Games provided in embodiments of the present invention are modified versions of the current genre of Multiline 5 Reel Video games. These games operate on a video screen 41 displaying 5 separate reels 40. Referring specifically to the embodiment of FIG. 1, three symbols 43 from each of the video reel strips are viewed on screen at any one time, for each of the 5 reels. The players have an option of playing 1, 3, 5, 7 or 9 different lines.

While the slot machine illustrated in FIG. 1 is of the simulated-spinning reel type, the present invention is equally applicable to any type of game found on the current generation of video slot machines and could also be applied to physical reel machines. The primary game of the slot machine will operate in the conventional manner and its operation will not be described in detail.

Figure 2:
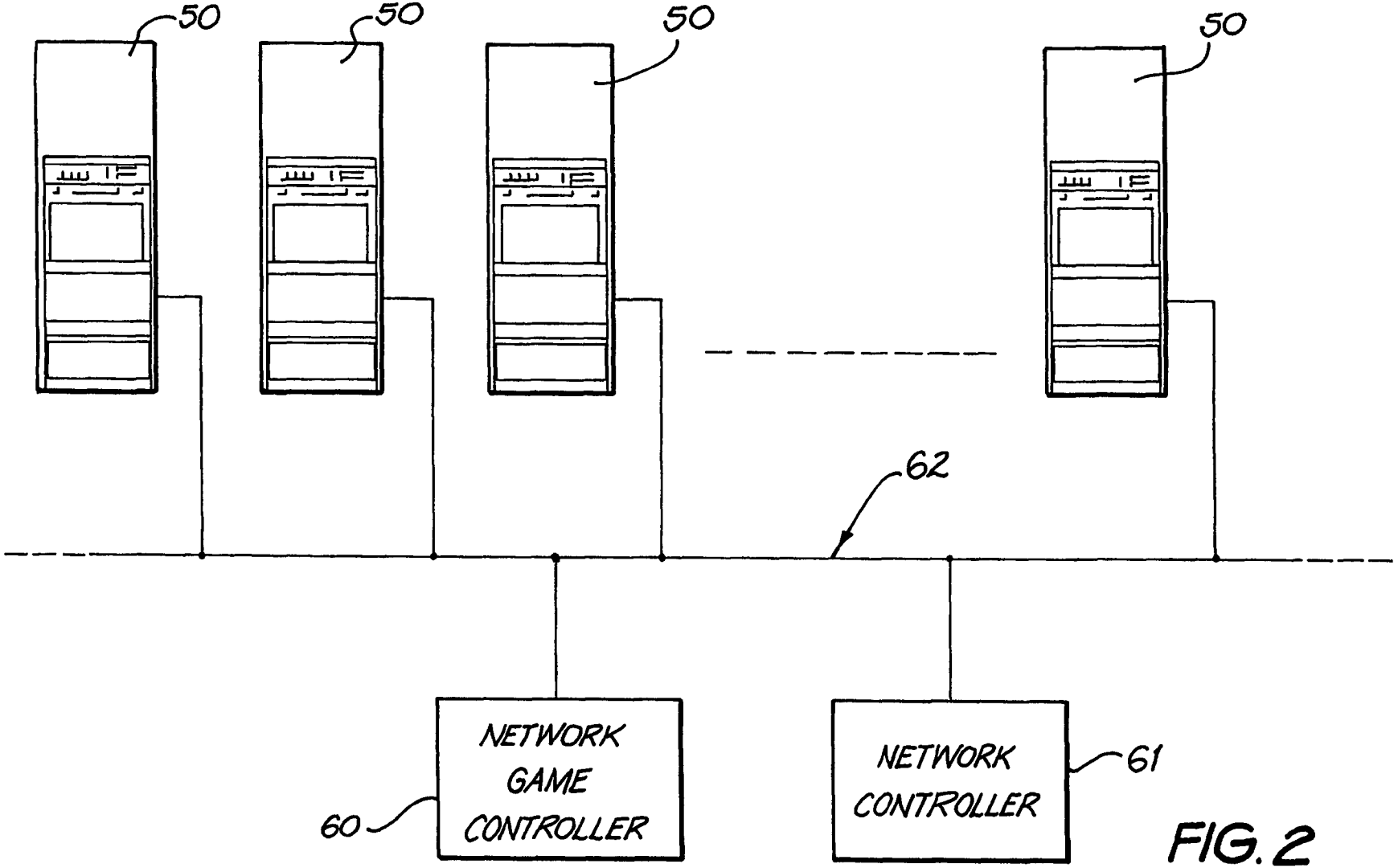
FIG. 2 schematically illustrates a network of gaming machines.

Referring to FIG. 2, a number of gaming consoles 50 are preferably connected in a network via a communications system 62, and the network controller 61. A network game controller 60 is also provided on the communications network 62 to control the accumulation of linked progressive prizes and the awarding of jackpots.

In a networked embodiment such as that shown in FIG. 2, the loyalty membership system may be implemented on either the network controller 61 or, the network game controller 60 or, alternatively a separate dedicated server (not shown) could be used to implement the loyalty membership system. Alternatively in a stand alone embodiment the functionality of the loyalty membership system is built into the controller of the gaming console itself.

Figure 3:
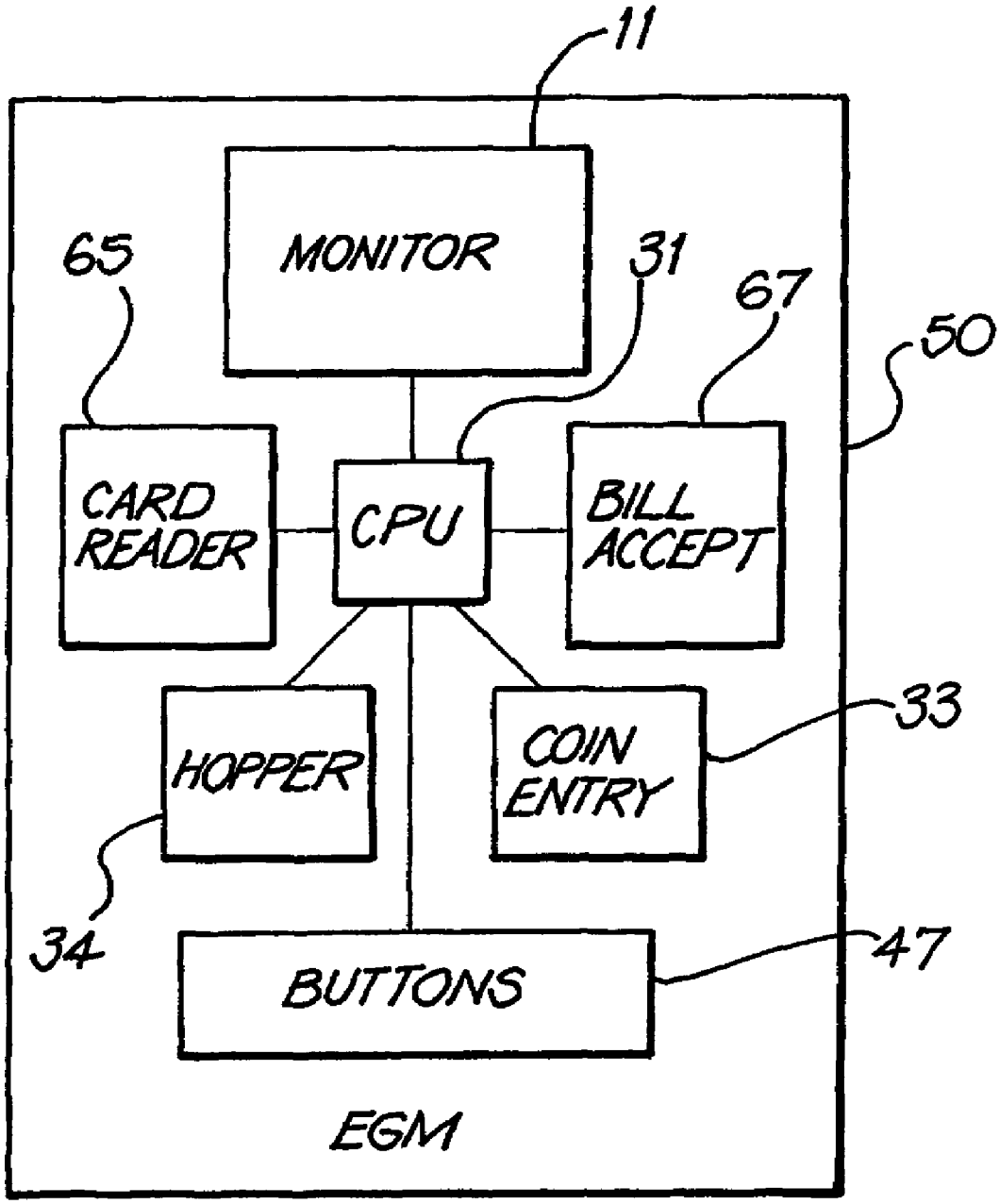
FIG. 3 is a block diagram of the gaming machine of FIG. 1, showing major functional elements.
Figure 4:
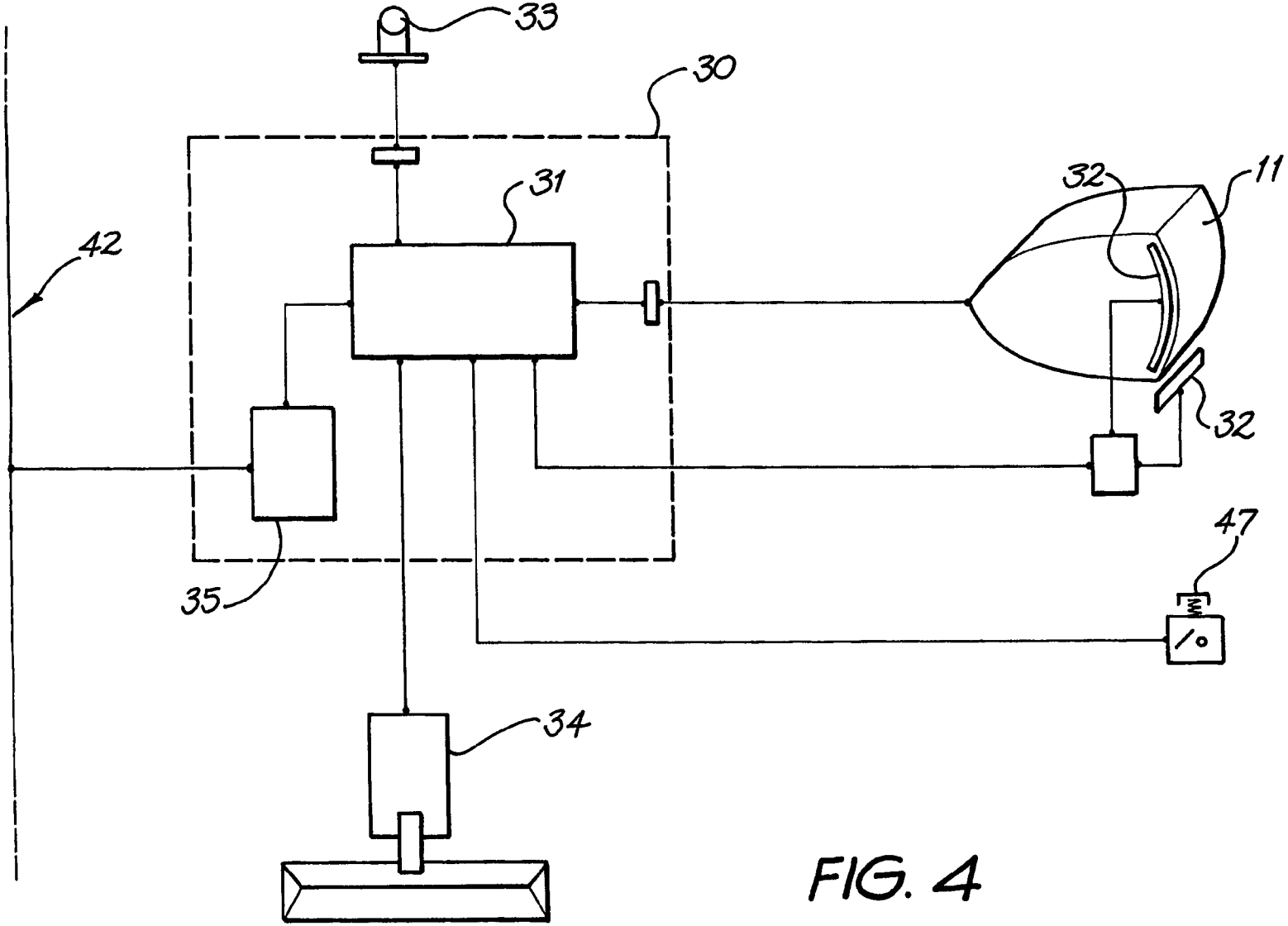
FIG. 4 is a further block diagram of a slot machine of FIGS. 1 and 3, showing optional touch screen and network connection functions.

The program to implement the base game described above, and to provide the normal mode of operation and the loyalty enhanced mode, runs on a standard gaming console control processor 31 as illustrated schematically in FIGS. 3 and 4. This processor forms part of a controller 30 which drives the display screen 11 and receives player input signals from push button switches 47. Alternatively, player inputs may be made by way of touch input signals from touch sensors 32. The console also receives coin input pulses from a coin chute mechanism 33 to establish a player credit and includes a coin payout mechanism or hopper 34. Connection to the communications network 42 is via a network interface 35.

In networked embodiments, the operation of the loyalty membership system is split between the game console 50 and the network game controller 60 with card reading and reward features being provided within the game console 50 and membership records being held on the central game controller with the identification and member information being passed between each participating machine 50 and the network controller 61 via the network 62. In the stand alone embodiment, the membership information is carried on a card read by the card reader, or alternatively the card simply signifies membership of a group entitled to additional features.

Referring again to FIGS. 1 and 3, each of the gaming machines within a gaming venue will preferably have a card reader 65 installed. Players are able to insert a membership card (smartcard or magnetic stripe card) into a gaming machine when they play, in order to qualify for additional member bonus features.

A manufacturer, club or casino can use the membership reward system to maintain player loyalty by issuing a members identification device such as a card (magnetic stripe or smartcard) to members. A club or casino may require a membership fee or a minimum monthly attendance before a player will be issued a card.

By inserting the member's card into the card reader of a gaming console, the player will become eligible for bonuses that they would not be eligible for without their card inserted. In one embodiment, special bonus features are provided that are independent of the base game, such as a special linked progressive jackpot system to be available only when the member card is inserted into the card reader of the machine.

A variety of features are suitable for selective inclusion in a game or as an extension to a game where a member's loyalty card is inserted into a machine. The embodiment described below is for a special feature incorporated into the base game to be made available when the card is inserted.

For the following example, there is a special second-screen bonus feature available that is triggered by the occurrence of 3 or more S symbols in a base game. The player is only eligible for this feature when their player card is inserted.

Referring to FIG. 5, a game display is illustrated for a game that was played without the member's card having been inserted. Even though 3 S symbols accrued, the feature is not triggered because the player is ineligible. However, the player is paid 40 credits for the 3 scattered S symbols as a part of the base game.

Figure 7:
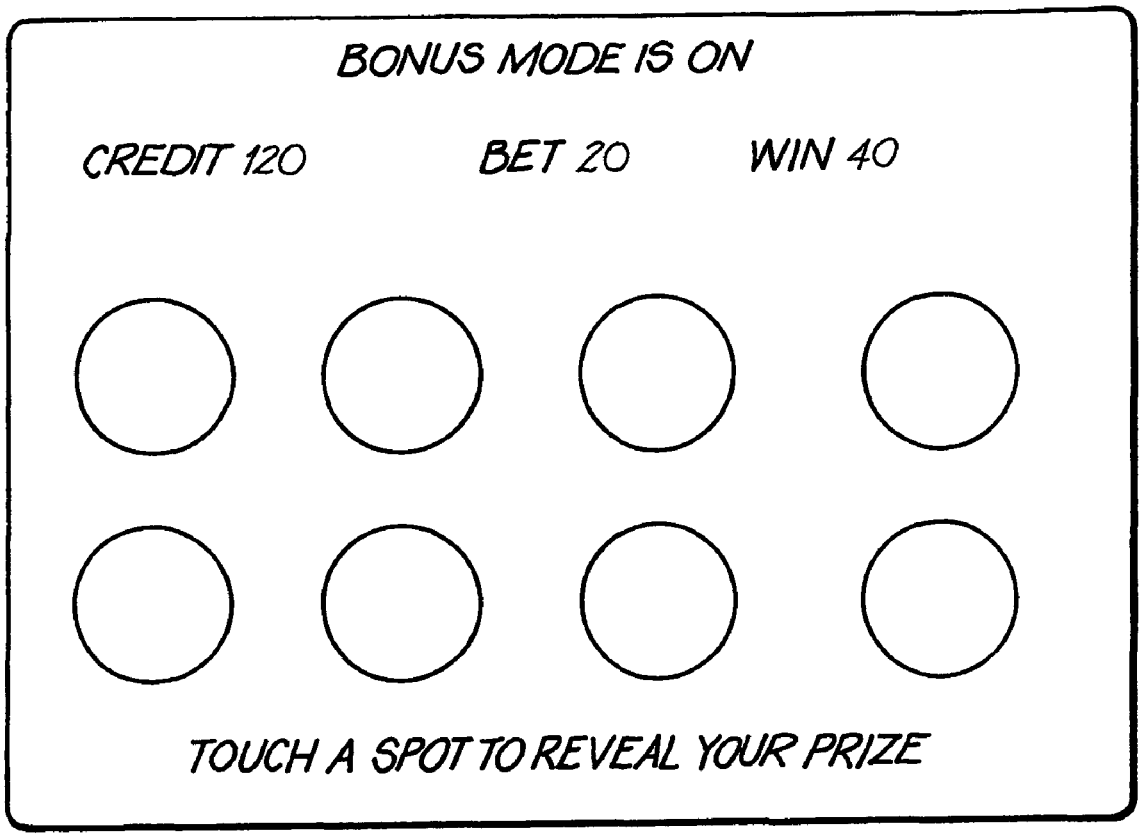

FIG. 6 illustrates a game display of a game played after the player has inserted their member's card. This time the bonus second-screen feature is triggered because the trigger combination of three or more S symbols occurred while the player card was inserted. The screen of FIG. 7 is then automatically presented. The second screen game illustrated in FIG. 7 may be common to all consoles in the establishment or at least a subset of consoles such that the same bonus feature is offered regardless of the base game when the membership card is inserted.

The bonus game in this instance is a simple "pick the window" type game where the player is invited to select one of eight spots on the screen by touching the selection. The screen is touch sensitive allowing the selection to be registered by the controller 31 (see FIGS. 3, 7, 4) and a prize associated with the selected spot is then revealed.

Embodiments may provide member-only features triggered from within a game as described above or features that are randomly triggered independently of the game being played and occur randomly at a predetermined average rate simply as a result of the membership card being inserted into the console.

In a further embodiment, the bonus feature may also be triggered by a conventional trigger regardless of whether the member card is inserted, however, when the card is inserted, the game may pay bigger prizes or more bonus games may be awarded when predefined trigger conditions occur.

Figure 8:
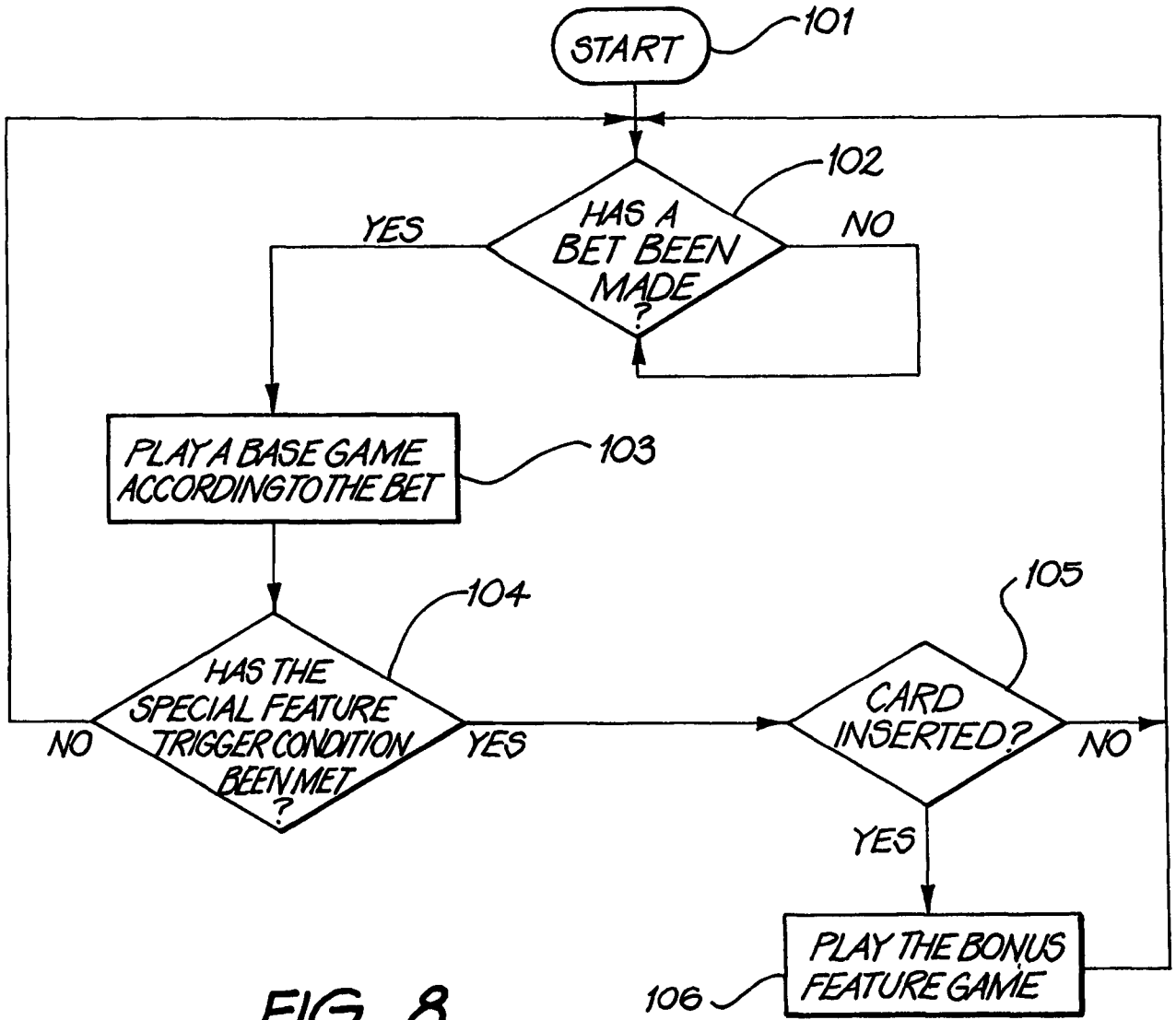
FIG. 8 is a flow chart showing the method of implementing the game described with reference to FIGS. 5, 6 & 7.

Referring to the flowchart of FIG. 8, the process step START (101) is an initialisation step performed when a player establishes a credit by inserting cash or transferring credit to the console. The console tests for the selection of a wager amount in step 102 to initiate a game. When a wager has been made, the base game plays in step 103 in accordance with the wager. Once the base game has completed the outcome is tested in step 104 to determine if any trigger conditions have occurred. In this context step 104 is only concerned with those trigger conditions which are activated when a member card is present. The base game may include other trigger conditions for features that are always provided, and these are not specifically described here. If no trigger conditions are detected, the console again waits for a wager in step 102, however, if a member bonus trigger condition has occurred, a test is performed at step 105 to determine if a member card has been inserted and if it has the bonus feature game is played at step 106. If step 105 does not detect a member's card present, the console again waits for a wager at step 102.

The bonus feature may also be available as a standard feature of the base game, such that other triggers (eg; combination triggers) in the game itself, may cause the feature to be invoked. The feature may be game specific, where a bonus feature that is built into the game and usually triggered by a certain random event or combination trigger is triggered by additional triggers when the member card is present. This also means that the expected return to player percentage of the applicable gaming machines will preferably be higher for a player taking part in the loyalty system than for one that is not.

The same approach could also be applied where the bonus is generic to all of the gaming machines that participate in the membership loyalty scheme. For example, a linked, progressive jackpot system may allow players to play the linked bonus feature in a larger number of circumstances or multiple progressive jackpots may be provided, of which some are only available when the members card is inserted. Similarly there could be a dedicated feature associated with the participating gaming machines that could be either game specific or generic that is only available to players who have inserted their members card. Hence players who do not use the members card will never be eligible to play that particular feature.

Preferably, an icon and message will be displayed on the game screen while the player's card is inserted to indicate that the player is currently eligible for special bonus features. When the card is removed the icon may disappear or be dulled out to further encourage the player to insert a card. The feature that the player becomes eligible for when their card is inserted may be of several different types.

Of the many types of features possible, some can be an extension to the base game. For example in a standard keno game 20 numbers are selected from a total of 80 and, if they match certain of the numbers that the player selected, a prize is awarded. When the player inserts their card the same keno game will allocate 21 numbers from the 80. That is, the apparent probability of a win will be increased by giving the player an extra number for every game. (Note that in some embodiments the probability may or may not be actually increased, but the player perception will be that the loyalty system results in a higher win probability).

Other types of feature can provide an extension to the game specific feature. This may be done by allowing the same trigger combination to provide a better feature when the members card is inserted (eg. instead of the usual 10 free games the player gets 20 free games or 10 free games with wins doubled). Alternatively the probability of the trigger may increase (eg. instead of 3 or more scatters triggering the feature, 2 or more will).

In some embodiments, the loyalty system player identification device may serve more than one function. For example, the Player Identification device may be a cashless gaming card such as a smartcard, where the card earns the player identification information and additionally, a monetary value stored on it. When inserted into the card reader, some or all of the monetary value can be transferred onto the credit meter of the gaming machine. Similarly, winnings can be transferred from the credit meter of the gaming machine onto the card, to be redeemed for cash when leaving the venue. The smartcards used for such a cashless system, when detected in the card reader of the gaming machine, can make the player eligible for certain bonus features while the card remains inserted in a similar manner to the other embodiments described above.

In another implementation of the member loyalty system a record of player option preferences is stored with the member information. This may also apply to the base game rather than just loyalty features. Possible options could be bet patterns, feature choices, favorite symbols, credit denominations game variables or similar. For example, a player may always bet maximum credits and may like to double-up on wins less than 100 credits. This information may be stored on their card or in the records held in the loyalty system on the network controller 61 so that when they move to another machine the bet will automatically be adjusted and they will be automatically taken to the double-up screen after wins of less than 100 credits and so on.

The member loyalty system may also add personality to the game being played. This might be done by holding details that are personal to the player and recorded in their account or on their card so that they can be incorporated into the bonus features. For example, a player information delivery system may greet the player by name, or a photograph or caricature of the player may be used as the top symbol in a spinning reel feature game.

In a further enhancement to embodiments of the invention, indication means are provided to advise a player when they are eligible for loyalty bonuses. This may take the form of a colour change in the background image of the display or a similar type of indication while the player is eligible for loyalty bonuses due to their card being present in the card reader of the gaming machine.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A gaming console for playing at least a game having a display means, player input means, and control means arranged to control images displayed on the display means in response to player inputs and game outcomes of games run on the console by the player, the set of possible game outcomes including game features comprising randomly triggered bonus events, the console being characterised in that it is arranged to operate in at least two modes, including a first, normal mode having standard game features and a second, loyalty enhanced mode, wherein the second mode is made available only to players who have established themselves in a loyalty system as members of a special eligibility group without reference to player history and the first mode is available to all players who are not members of the special eligibility group, and wherein the second mode differs from the first mode in that in the second mode, instances of the game being played are provided with enhanced or additional game features with regard to the features of the first mode, wherein the enhanced or additional game features provided on each occurrence of a triggering event are related to the play of a said game on the console, and wherein the control means in response to the player establishing themselves as a member of the special eligibility group, causes the display means to display a notice identifying that the player has been identified as a member of the special eligibility group.

2. The gaming console as claimed in claim 1, wherein the second mode is distinguished from the first mode by providing higher prizes.

3. The gaming console as claimed in claim 1, wherein the second mode is distinguished from the first mode by providing additional prizes.

4. The gaming console as claimed in claim 1, wherein the second mode is distinguished from the first mode by providing additional game features as standard features of the game.

5. The gaming console as claimed in claim 1, wherein the second mode is distinguished from the first mode by providing additional, purchasable, game features within a standard game.

6. The gaming console as claimed in claim 1, wherein the second mode is distinguished from the first mode by providing a higher probability of winning a prize in an otherwise standard game.

7. The gaming console as claimed in claim 1, wherein the second mode is distinguished from the first mode by providing a predetermined number of free games on the occurrence of the triggering event an otherwise standard game.

8. The gaming console as claimed in claim 1, wherein the second, loyalty mode includes a feature which is related to a system event in a linked system.

9. The gaming console as claimed in claim 8, wherein the second, loyalty mode provides eligibility to a progressive jackpot.

10. The gaming console as claimed in claim 1, wherein the second mode is distinguished from the first mode by providing eligibility to an additional bonus.

11. The gaming console as claimed in claim 10, wherein the bonus is related to particular outcomes on the main game.

12. The gaming console as claimed in claim 11, wherein a main game available for play on the console is a spinning reel game in which a plurality of reel strips carrying symbols are spun and when the reel strips stop spinning part of each reel strip is displayed and prizes are awarded for predetermined combinations of symbols appearing together on the displayed parts of the reel strips.

13. The gaming console as claimed in claim 10, wherein the bonus comprises an additional feature game.

14. The gaming console as claimed in claim 13, wherein the additional feature game is an independent second screen game.

15. The gaming console as claimed in claim 12, wherein the bonus available in the second, loyalty mode comprises awarding a predetermined number of free games on the occurrence of the triggering event a standard game.

16. The gaming console as claimed in claim 15, wherein the bonus comprises awarding 10 free games on the occurrence of the trigger.

17. The gaming console as claimed in claim 15, wherein the triggering event is the occurrence of a predetermined combination of symbols spun up in the standard game.

18. The gaming console as claimed in claim 17, wherein the combination of symbols comprises a plurality of similar symbols.

19. The gaming console in claim 18, wherein the combination of symbols comprises scatter symbols.

20. The gaming console as claimed in claim 18, wherein the combination of symbols comprises substitute symbols.

21. The gaming console as claimed in claim 12, comprising a feature wherein, when a triggering event occurs, a bonus prize is awarded for every occurrence of a second predetermined symbol that appears in a subsequent predetermined number of games played.

22. The gaming console as claimed in claim 21, wherein the bonus prize is 5 credits.

23. The gaming console as claimed in claim 21, wherein the first predetermined symbol is an "EYE" symbol.

24. The gaming console as claimed in claim 21, wherein the triggering event comprises the first predetermined symbol appearing at the same time on two reels in the main game.

25. The gaming console as claimed in claim 21, wherein the second predetermined symbol is a "KING" symbol.

26. The gaming console as claimed in claim 21, wherein the number of subsequent games in which the player is eligible for the bonus prize is the next 20 games played.

27. The gaming console as claimed in claim 12, wherein the additional bonus in the second loyalty mode comprises awarding a second screen feature game to the player, and the feature game awarding a bonus prize.

28. The gaming console as claimed in claim 11, wherein the additional bonus feature provides additional prizes for outcomes over a predetermined level.

29. The gaming console as claimed in claim 11, wherein the additional bonus feature provides additional prizes for outcomes containing a predetermined indicia.

30. The gaming console as claimed in claim 1. wherein the function of standard game features is altered when the console is operating in the second, loyalty enhanced mode.

31. The gaming console as claimed in claim 30, wherein a standard game feature comprises awarding a bonus on the occurrence of the triggering event and in the second, loyalty enhanced mode the bonus is increased.

32. The gaming console as claimed in claim 31, wherein the bonus in the first, normal mode comprises awarding a first predetermined number of free games and the second, loyalty enhanced mode comprises awarding a second, predetermined number of free games, the second predetermined number of free games being a greater number than the first predetermined number of free games.

33. The gaming console as claimed in claim 32, wherein the second predetermined number of free games is double the first predetermine number of free games.

34. The gaming console as claimed in claim 32, wherein the first predetermined number of free games comprises 10 free games.

35. The gaming console as claimed in claim 32, wherein the second predetermined number of free games comprises 20 free games.

36. The gaming console as claimed in claim 30, wherein the bonus comprises awarding a second screen feature.

37. The gaming console as claimed in claim 31, wherein the triggering event is the occurrence of a predetermined combination of symbols in a standard game.

38. The gaming console as claimed in claim 37, wherein the predetermined combination of symbols comprises two similar symbols.

39. The gaming console as claimed in claim 37, wherein the predetermined combination of symbols comprises three similar symbols.

40. The gaming console as claimed in claim 37, wherein the predetermined combination of symbols comprises scatter symbols.

41. The gaming console as claimed in 37, wherein the predetermined combination of symbols comprises substitute symbols.

42. The gaming console as claimed in claim 31, wherein the trigger required when the second, loyalty enhanced mode is enabled is easier to achieve than the trigger required when the first, normal mode of the game is operating.

43. The gaming console as claimed in claim 41, wherein the trigger in the first, normal mode comprises the occurrence of a predetermined symbol a first predetermined number of times in a winning combination during a standard game.

44. The gaming console as claimed in claim 43, wherein the trigger in the second, loyalty enhanced mode comprises the occurrence of the predetermined symbol a second predetermined number of times in a winning combination during a standard game, the second predetermined number being less than the first predetermined number.

45. The gaming console as claimed in claim 44, wherein the second predetermined number is one less than the first predetermined number.

46. The gaming console as claimed in claim 44, wherein the second predetermined number is one.

47. The gaming console as claimed in claim 44, wherein the first predetermined number is three.

48. The gaming console as claimed in claim 44, wherein the predetermined symbol comprises a substitute symbol.

49. The gaming console as claimed in claim 44, wherein the predetermined symbol comprises a scatter symbol.

50. The gaming console as claimed in claim 1, wherein the second mode is distinguished from the first mode by providing eligibility to additional jackpot prizes.

51. The gaming console as claimed in claim 1, wherein a game runnable on the console by the player comprises a card game.

52. The gaming console as claimed in claim 1, wherein a game runnable on the console by the player comprises a spinning reel game.

53. The gaming console as claimed in claim 1, wherein a game runnable on the console by the player comprises a keno game.

54. The gaming console as claimed in claim 1, wherein a game runnable on the console by the player comprises a bingo game.

55. The gaming console as claimed in claim 1, wherein a game runnable on the console by the player comprises additional feature games.

56. The gaming console as claimed in claim 1, wherein membership of the eligible group is indicated to the console by use of special identification means.

57. The gaming console as claimed in claim 56, wherein the identification means is an identification card.

58. The gaming console as claimed in claim 56, wherein the identification means is a key.

59. The gaming console as claimed in claim 54, wherein the identification means is a password which must be entered into the console.

60. The gaming console as claimed in claim 1, wherein the loyalty system is implemented on a "stand alone" console.

61. The gaming console as claimed in claim 60, wherein the console is provided with a card reader that reads a special membership card.

62. The gaming console as claimed in claim 61, wherein, when the card is inserted into the card reader, the console recognises the player as a member and the player will become eligible for the features of the second, loyalty-enhanced mode.

63. The gaming console as claimed in claim 62, wherein information on the card enables the console to establish the player's identity, and play in the enhanced mode cannot commence until the console has identified the player.

64. The gaming console as claimed in claim 61, wherein information on the card enables the console to establish the player's membership of the eligibility group without establishing the player's identity, and play in the enhanced mode is enabled to commence when the player is recognised as a member of the class eligible for the enhanced mode.

65. The gaming console as claimed in claim 1, wherein the loyalty system is implemented on a plurality of networked consoles.

66. The gaming console as claimed in claim 65, wherein the loyalty system includes player details and the player details are maintained on a network server.

67. The gaming console as claimed in 65, wherein the loyalty system includes player details and the player details are maintained on a dedicated loyalty system server.

68. The gaming console as claimed in claim 66, wherein the identification means are used only to identify the player to the system so that the player details can be retrieved.

69. A gaming apparatus comprising a display and a user interface in communication with a game controller, the user interface allowing a player of the gaming apparatus to provide to the gaming apparatus information identifying the player as a member of a special eligibility group, the gaming apparatus providing a game in which a plurality of game symbols are displayed in a respective number of symbol positions to form at least one outcome, and wherein the gaming apparatus provides the game for both players that have been identified as a member of the special eligibility group and other players, but following each occurrence of a particular event related to play of game during play of the game, the gaming apparatus provides the game with enhanced play characteristics that provide a higher expected return to player if the player has been identified as a member of the special eligibility group relative to the play characteristics provided when the player has not been identified as a member often special eligibility group and wherein the gaming apparatus in response to the player providing information identifying themselves as a member of the special eligibility group displays on the display an indicator that the player has been identified as a member of the special eligibility group.

70. The gaming apparatus of claim 69, wherein the enhanced play characteristics are provided in a bonus feature, and comprise the bonus feature paying bigger prizes.

71. The gaming apparatus of claim 69, wherein the game awards a bonus feature comprising a series of bonus games on the occurrence of the particular event and wherein the enhanced play characteristics comprises awarding a bonus feature comprising a larger number of bonus games.

72. The gaming apparatus of claim 71, wherein the particular event is a particular outcome of the game.

73. The gaming apparatus of claim 69, wherein the enhanced play characteristics comprise the awarding of a bonus feature that would not otherwise be awarded on the occurrence of the particular event.

74. The gaming apparatus of claim 73, wherein the bonus feature is also awarded on the occurrence of at least one other event, regardless of whether or not the player has been identified as a member of the special eligibility group.

75. The gaming apparatus of claim 69, wherein the particular event occurs independently of the game and randomly at a predetermined average rate.

76. A gaming apparatus comprising a display and a user interface in communication with a game controller, the user interface allowing a player of the gaming apparatus to provide to the gaming apparatus information identifying the player as a member of a special eligibility group, the gaming apparatus providing a game comprising a base game and a bonus feature comprising a series of bonus games, the outcomes of which determine a prize that is awarded as a result of play of the bonus feature, wherein the bonus feature is awarded following the occurrence of a trigger event during play of the base game, and wherein for the entire duration that the player has provided to the gaming apparatus information identifying the player as a member of the special eligibility group, the bonus feature pays bigger prizes relative to when the player has not been identified as a member of the special eligibility group.

77. The gaming apparatus of claim 76, wherein when the player has not been identified as a member of the special eligibility group and said predefined event occurs, the gaming apparatus displays a message to the player indicating that they have not been identified as a member of the special eligibility group.

78. The gaming apparatus of claim 77, wherein the message is at least one of text displayed on the display and an icon displayed on the display.

79. A gaming apparatus comprising a display and a user interface in communication with a game controller, the user interface allowing a player of the gaming apparatus to provide to the gaming apparatus information identifying the player as a member of a special eligibility group, the gaming apparatus providing a game comprising a base game and a bonus feature comprising a series of bonus games, the bonus feature awarded following the occurrence of a predefined event during play of the base game, wherein when the player has been identified as a member of the special eligibility group, the bonus feature comprises more bonus games relative to when the player has not been identified as a member of the special eligibility group.

80. The gaming apparatus of claim 79, wherein when the player has not been identified as a member of the special eligibility group and said predefined event occurs, the gaming apparatus displays a message to the player indicating that they have not been identified as a member of the special eligibility group.

81. The gaming apparatus of claim 79, wherein the bonus feature always results in the award of a prize.

82. A gaming system comprising a plurality of gaming machines each having a display and a player interface in communication with a controller that controls images displayed on the display in response to player inputs and game outcomes of games played on the gaming machine by a player, each gaming machine being arranged to operate in at least two modes, including a first mode and a second mode, wherein the first mode is available to all players and the second mode is made available only to players who have used the player interface to establish themselves as members of a special eligibility group, wherein at least two of the gaming machines provide different games, but provide a common bonus feature to their respective games on each occurrence of a particular game play related event during play of their respective games when in the second mode, and wherein the earning system in response to the player establishing themselves as a member of the special eligibility group displays on the display of each gaming machine that is being played an indicator of whether the player has been identified as a member of the special eligibility group.

83. The gaming system of claim 82, wherein the bonus feature is a second screen game that is provided at one of the plurality of gaming machines on the occurrence of a particular event during play of a game provided by that gaming machine.

84. The gaming system of claim 83, wherein the particular event is the occurrence of a particular game outcome.

85. The gaming system of claim 82, wherein the bonus feature is provided independently of the game outcomes.

86. The gaming system of claim 85 comprising a progressive prize controller that maintains a progressive prize that is contributed to by the at least two gaming machines and an outcome of the bonus feature is the winning of the progressive prize.

87. The gaming system of claim 82, wherein the plurality of gaming machines comprise a plurality gaming machines that provide a common game and provide the common feature.

88. A gaming system comprising a plurality of gaming machines and a computational controller and associated memory storing player identification information of players that are members of a special eligibility group, each gaming machine comprising a player interface to receive player identification information and a communications interface to communicate player identification information received from the player interface to the computational controller, the gaming system providing enhanced play characteristics during play of a game on one of the gaming machines if player identification information communicated by that gaming machine to the computational controller indicates that the player is a member of the special eligibility group, the enhanced play characteristics being provided on one of the gaming machines following each occurrence of a particular game play related event during play of a game on that gaming machine without regard to any historical player activity that may have been recorded by the gaming system, wherein the gaming system displays on the display an indicator of whether the player has been identified as a member of the special eligibility group.

89. The gaming system of claim 88, wherein the player identification information is provided to the gaming machines using a player identification device that is also at least one of a cashless gaming instrument that allows a player to transfer credits onto and off the credit meters of the gaming machines and a storage medium of player preferences.

90. A method of operating a gaming apparatus, the method comprising accepting a payment from a player of the gaming apparatus in return for membership in a special eligibility group, allocating the player a player identifier, using the gaming apparatus to monitor for receipt of the player identifier and during the term of the membership, in response to receipt of the player identifier at the gaming apparatus, modifying the play characteristics of a game played at the gaming apparatus to provide an increased expected return to player, the modification not being dependent on any player history information.

91. The method of claim 90, wherein modifying play characteristics of the gaming apparatus comprises modifying the gaming apparatus so as to award a larger prize when a particular winning outcome occurs in the game than would have been awarded without the modification.

92. The method of claim 91, wherein the particular winning outcome is an outcome of a bonus feature to a base game provided on the gaming apparatus.

93. The method of claim 90 when applied to a plurality of gaming apparatuses, wherein for each gaming apparatus modifying the play characteristics involves providing the same feature game on the occurrence of a predefined event in a game played on that gaming apparatus.

94. The method of claim 93, wherein for each gaming apparatus modifying the play characteristics involves providing the ability to win a progressive prize through play of the feature game, the progressive prize not otherwise being able to be won.

95. The method of claim 90 when applied to a plurality of gaming apparatuses, wherein for each gaming apparatus modifying the play characteristics involves providing eligibility to win a progressive prize that is not otherwise able to be won.

* * * * *